US008302697B2

(12) United States Patent
Kuo

(10) Patent No.: US 8,302,697 B2
(45) Date of Patent: Nov. 6, 2012

(54) INSTALLATION OF TUBULAR STRINGS WITH LINES SECURED THERETO IN SUBTERRANEAN WELLS

(75) Inventor: Nicholas A. Kuo, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 12/846,482

(22) Filed: Jul. 29, 2010

(65) Prior Publication Data

US 2012/0024545 A1 Feb. 2, 2012

(51) Int. Cl.
*E21B 47/01* (2012.01)

(52) U.S. Cl. ..... 166/385; 166/66

(58) Field of Classification Search ..... 166/385, 166/66, 242.2
See application file for complete search history.

(56) References Cited

U.S. PATENT DOCUMENTS

| | | | | |
|---|---|---|---|---|
| 4,573,715 | A * | 3/1986 | Armbruster | 285/94 |
| 5,379,836 | A | 1/1995 | Jordan | |
| 6,186,229 | B1 | 2/2001 | Martin et al. | |
| 6,302,203 | B1 | 10/2001 | Rayssiguier et al. | |
| 6,367,845 | B1 | 4/2002 | Otten et al. | |
| 6,412,565 | B1 | 7/2002 | Castano-Mears | |
| 6,415,869 | B1 | 7/2002 | Smith | |
| 6,554,064 | B1 | 4/2003 | Restarick et al. | |
| 6,681,854 | B2 | 1/2004 | Danos | |
| 6,684,951 | B2 | 2/2004 | Restarick et al. | |
| 6,789,621 | B2 | 9/2004 | Wetzel et al. | |
| 6,817,410 | B2 | 11/2004 | Wetzel et al. | |
| 6,983,796 | B2 | 1/2006 | Bayne et al. | |
| 7,063,143 | B2 | 6/2006 | Tilton et al. | |
| 7,104,324 | B2 | 9/2006 | Wetzel et al. | |
| 7,131,494 | B2 | 11/2006 | Bixenman et al. | |
| 7,165,892 | B2 | 1/2007 | Grigsby et al. | |
| 7,182,134 | B2 | 2/2007 | Wetzel et al. | |
| 7,220,067 | B2 | 5/2007 | Rubinstein et al. | |
| 7,222,676 | B2 | 5/2007 | Patel et al. | |
| 7,228,898 | B2 | 6/2007 | Grigsby et al. | |
| 7,252,437 | B2 | 8/2007 | Ringgenberg | |
| 7,866,405 | B2 | 1/2011 | Richards et al. | |
| 2002/0053439 | A1 | 5/2002 | Danos | |
| 2002/0125009 | A1 | 9/2002 | Wetzel et al. | |

(Continued)

FOREIGN PATENT DOCUMENTS

WO 02055841 A2 9/2003

OTHER PUBLICATIONS

Weatherford, "Optical Sensing Systems", Product Brochure 4136.00, dated 2006, 16 pages.

(Continued)

*Primary Examiner* — William P Neuder
(74) *Attorney, Agent, or Firm* — Smith IP Services, P.C.

(57) ABSTRACT

A system which attaches at least one line to a tubular string can include at least one clip pivotably secured on one side of a recess. At least one structure is positioned on an opposite side of the recess. Rotation of the clip into engagement with the structure secures the line in the recess. A method of attaching at least one line to a tubular string can include securing the line to a support on the tubular string as the tubular string is being conveyed into a wellbore. The securing step further includes rotating at least one clip into engagement with at least one structure, thereby preventing removal of the line from a recess formed in the support.

18 Claims, 9 Drawing Sheets

U.S. PATENT DOCUMENTS

| | | | | |
|---|---|---|---|---|
| 2003/0000875 | A1 | 1/2003 | Echols et al. | |
| 2004/0035590 | A1 | 2/2004 | Richard | |
| 2004/0065437 | A1 | 4/2004 | Bostick et al. | |
| 2006/0159400 | A1 | 7/2006 | Richards et al. | |
| 2009/0126943 | A1 | 5/2009 | Roaldsness | |
| 2010/0243272 | A1 * | 9/2010 | Coronado | 166/380 |

OTHER PUBLICATIONS

Schlumberger, "Fiber-Optic Distributed Vibration Sensing Provides Technique for Detecting Sand Production", Technical Paper, dated 2009, 1 page.

Schlumberger, "Fiber-Optic-Compatible Screens", SC_03_006_0, dated Jan. 2004, 2 pages.

Weatherford, Product Release, dated 2007, 2 pages.

International Search Report with Written Opinion issued Feb. 21, 2012 for International Patent Application No. PCT/US11/044659, 11 pages.

International Search Report and Written Opinion issued Aug. 27, 2009, for International Patent Application Serial No. PCT/US09/49650, 7 pages.

Oil & Gas Journal, vol. 101, issue 13, "Fiber Optics Profiles Real-time Temperature across Horizontal Lateral," 10 pages, dated Mar. 31, 2003.

Oil & Gas Journal, "Fiber Optics, Advanced Technologies Complete ERD Producer/Injector," pp. 47-52, dated Jul. 5, 1999.

SPE 77682, "Fiber Optic Monitoring in Openhole Gravel Pack Completions," 14 pages, dated 2002.

Paulo Tubel, "Intelligent Systems for Optimized Reservoir Management and Improved Oil Recovery," 16 pages, undated.

Office Action issued Aug. 2, 2012 for U.S. Appl. No. 13/485,452, 6 pages.

Specification and Drawings for Continuation U.S. Appl. No. 13/485,452, filed May 31, 2012, 25 pages.

* cited by examiner

INSTALLATION OF TUBULAR STRINGS WITH LINES SECURED THERETO IN SUBTERRANEAN WELLS

BACKGROUND

This disclosure relates generally to equipment utilized and operations performed in conjunction with a subterranean well and, in an example described below, more particularly provides for installation of tubular strings with lines secured thereto in wells.

It would be advantageous to be able to quickly, reliably and economically attach lines to a tubular string as it is being lowered into a well. This would enable the tubular string and the lines to be conveniently installed together, without significantly impeding the installation of either of these. Such an attachment system should also preferably protect the lines during installation.

SUMMARY

In the disclosure below, an attachment system and method are provided which bring improvements to the art of securing lines to tubular strings. One example is described below in which a support protects a line within a recess formed in the support. Another example is described below in which the line is retained in the recess by a rotatable clip.

In one aspect, the present disclosure provides to the art a system which attaches at least one line to a tubular string. The system can include at least one clip pivotably secured on one side of a recess. At least one structure is positioned on an opposite side of the recess. Rotation of the clip into engagement with the structure secures the line in the recess.

In another aspect, a method of attaching at least one line to a tubular string is provided by the disclosure. The method can include securing the line to a support on the tubular string as the tubular string is being conveyed into a wellbore. The securing step further includes rotating at least one clip into engagement with at least one structure, thereby preventing removal of the line from a recess formed in the support.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
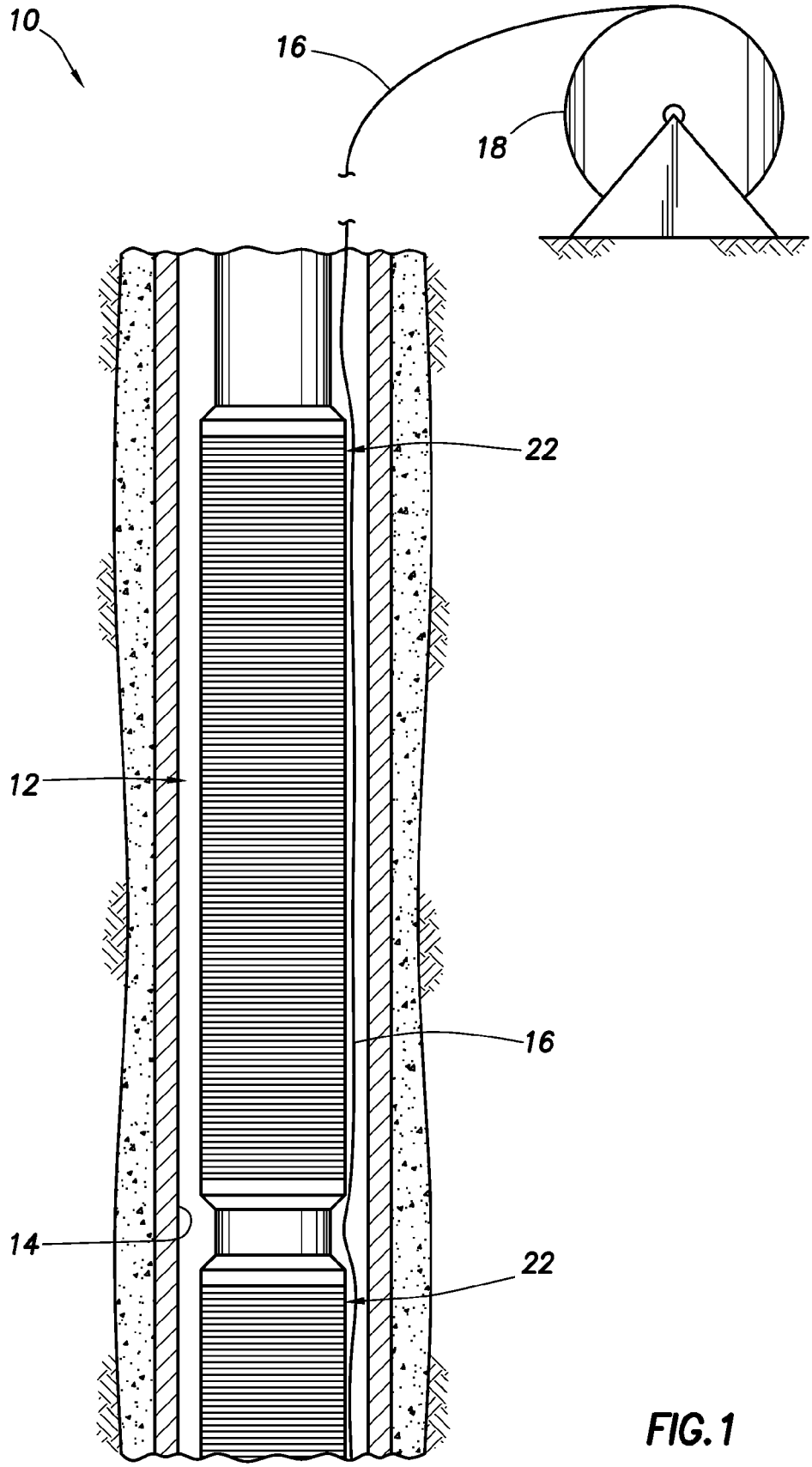
FIG. 1 is a schematic partially cross-sectional view of a well system and associated method which can embody principles of the present disclosure.

Representatively illustrated in FIG. 1 is a well system 10 and associated method which can embody principles of this disclosure. As depicted in FIG. 1, a tubular string 12 is being conveyed into a wellbore 14. As the tubular string 12 is being lowered into the wellbore 14, a cable 16 comprising one or more lines (e.g., hydraulic or electrical lines, optical waveguides, etc.) is attached to the exterior of the tubular string, such as, by unrolling the cable from a reel or spool 18 at the surface and securing the cable to exteriors of well screens 22 interconnected as part of the tubular string.

At this point it should be understood that the system 10 illustrated in FIG. 1 is merely one example of a wide variety of different systems that can embody principles of this disclosure. For example, although the wellbore 14 is depicted in FIG. 1 as being cased, the wellbore could be uncased or open hole in other systems. As another example, the cable 16 is not necessarily unrolled from a reel 18 at the surface, and the cable is not necessarily attached to an exterior surface of a well screen 22, in systems which utilize the principles of this disclosure. Those principles are not limited at all to any of the details of any of the examples shown in the drawings and otherwise described in this specification.

Although not visible in FIG. 1 (see FIG. 2), a line attachment system 20 is used to secure the cable 16 to the tubular string 12 as it enters the wellbore 14. The line attachment system 20 preferably provides for quick, efficient and convenient attachment of the cable 16 to the tubular string 12.

Figure 2:
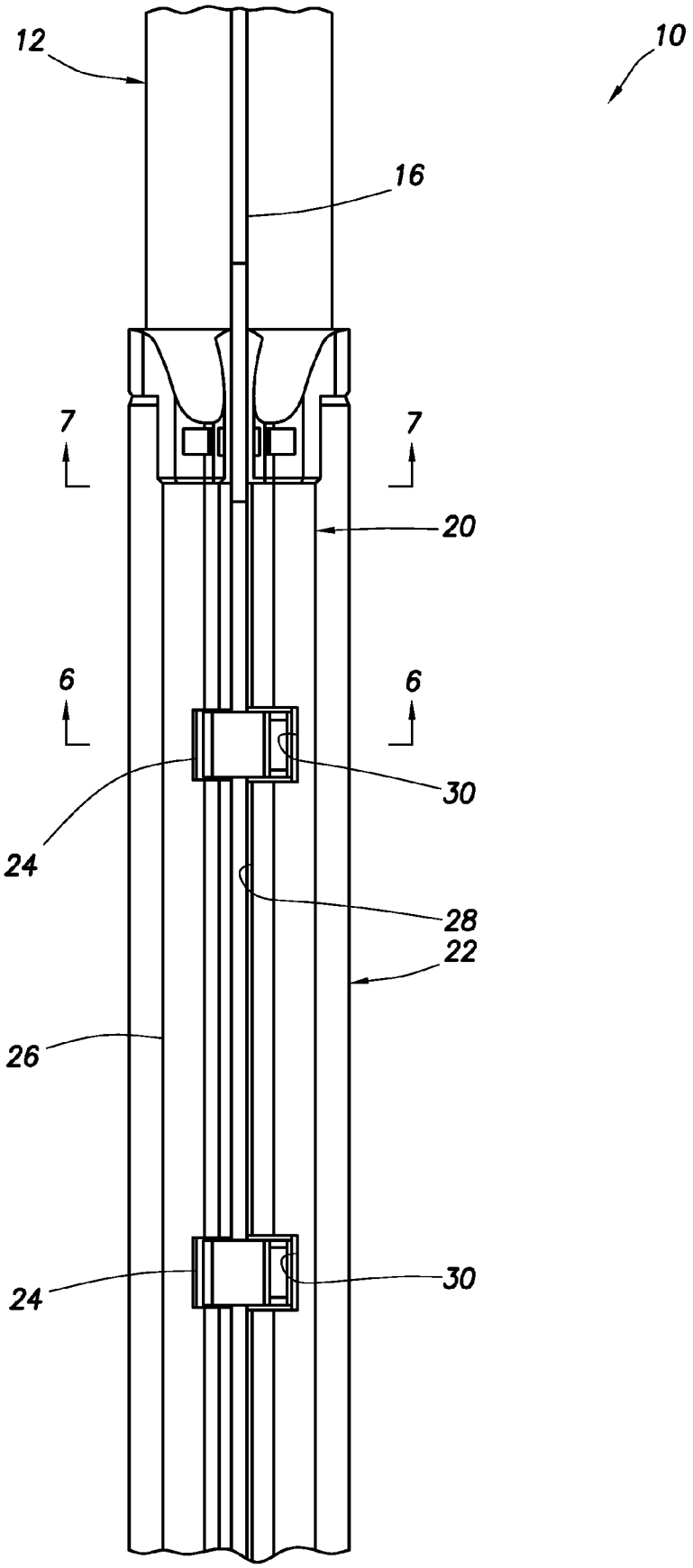
FIG. 2 is a schematic enlarged scale elevational view of a line attachment system which can embody principles of this disclosure.

Referring additionally now to FIG. 2, an enlarged scale view of a section of the tubular string 12 (including a part of one of the well screens 22) is representatively illustrated. In this view, it can be seen that the line attachment system 20 includes clips 24 which extend laterally over the cable 16 to secure it to an exterior of the well screen 22.

As described more fully below, the clip 24 is pivotably attached to a support 26 on one side of a channel or longitudinal recess 28 formed in the support. The clip 24 engages an opening or other structure 30 on an opposite side of the recess 28.

Figure 3:
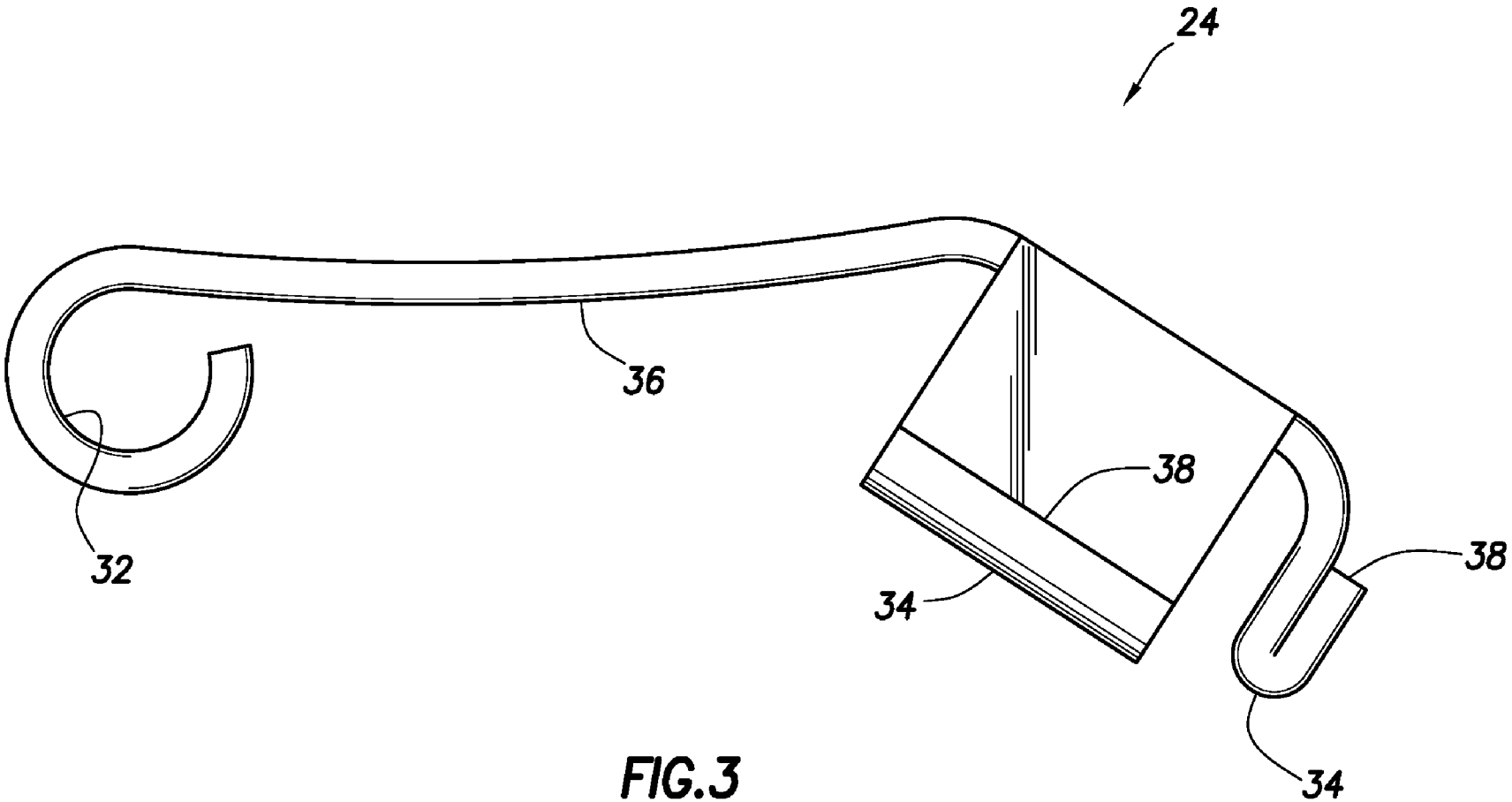
FIG. 3 is a schematic enlarged scale elevational view of a clip which may be used in the attachment system.

Referring additionally now to FIG. 3, an enlarged scale view of the clip 24 apart from the remainder of the system 20 is representatively illustrated. In this view, it can be seen that the clip 24 includes an elongated eye 32 for receiving a pivot pin, resilient locking fingers 34, and a body 36 extending between the eye and the locking fingers. The locking fingers 34 each have shoulders 38 formed thereon for preventing removal of the fingers from the opening or structure 30.

Figure 4:
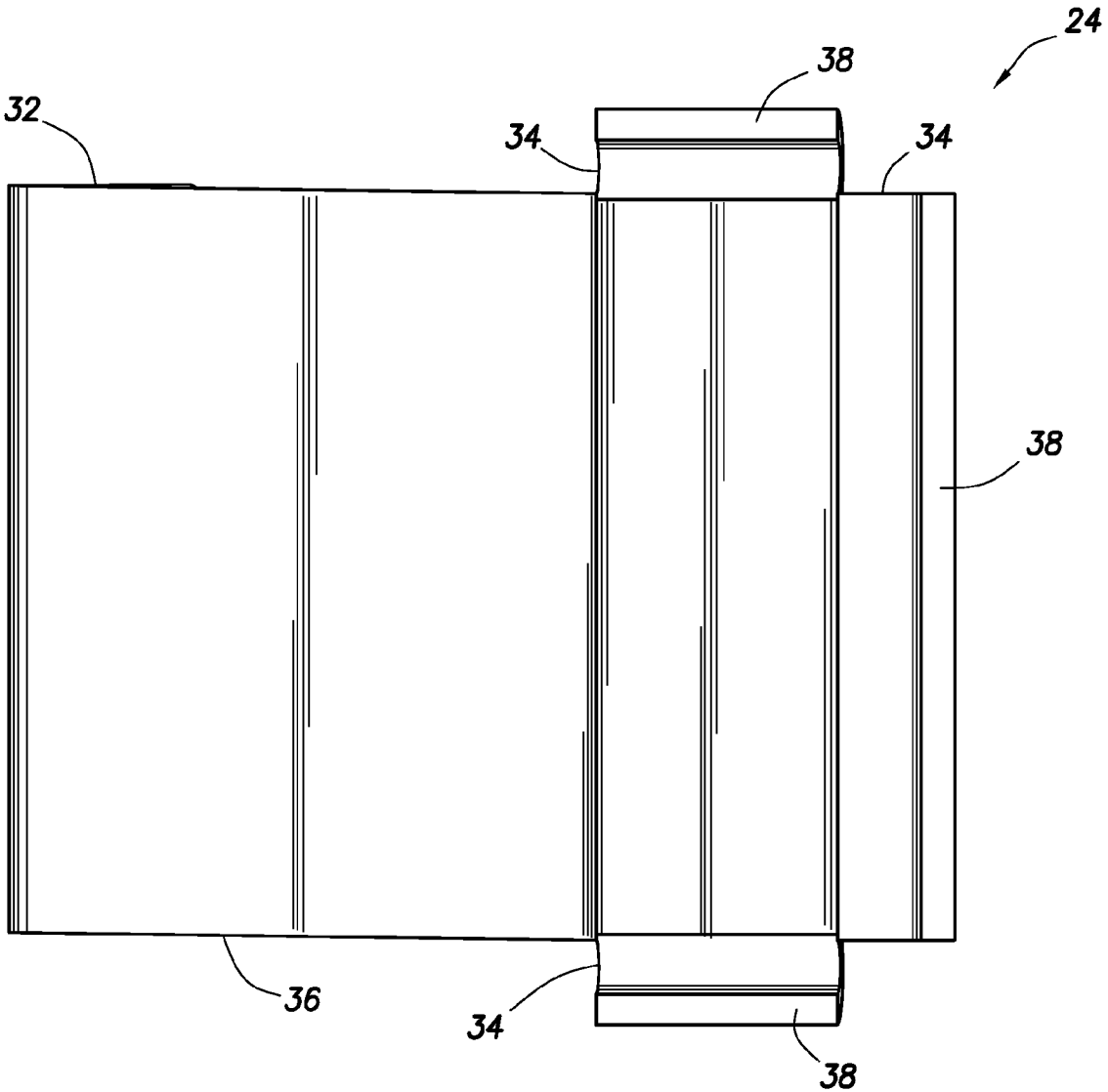
FIG. 4 is a schematic enlarged scale plan view of the clip.

Referring additionally now to FIG. 4, a plan view of the clip 24 is representatively illustrated. In this view, it can be seen that the clip 24 includes three locking fingers 34.

Engagement between the locking fingers 34 and the opening or structure 30 prevents one end of the clip 24 from being detached from the support 26 on one side of the recess 28. The other end of the clip 24 is pivotably attached on an opposite side of the recess 28. Thus, when the locking fingers 34 are engaged with the structure 30, the body 36 of the clip 24 prevents removal of the cable 16 from the recess 28.

Although the "male" structure of this locking engagement (the locking fingers 34) is depicted as being on the clip 24, and the "female" part of this locking engagement (the opening) is depicted as being on the support 26, it will be appreciated that the male and female structures could be reversed, other types of structures (whether or not they are male or female) could be used, etc., in keeping with the principles of this disclosure.

Figure 5:
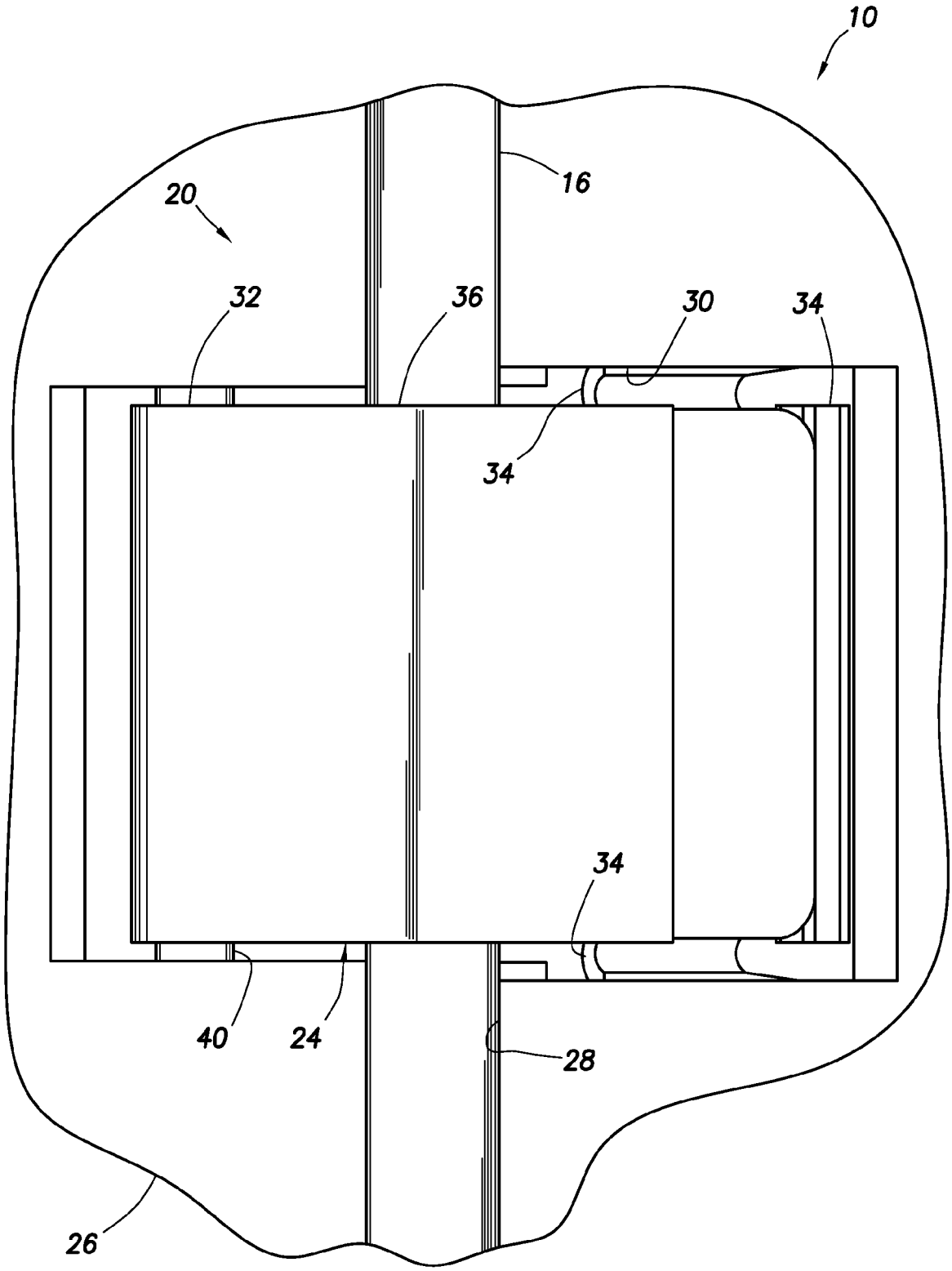
FIG. 5 is a schematic plan view of the clip engaged with a structure in a support of the attachment system.

Referring additionally now to FIG. 5, the manner in which the clip 24 and support 26 operate to secure the cable 16 to the exterior of the well screen 22 is representatively illustrated. Note that the clip 24 has been rotated about a pivot pin 40, so that the body 36 overlies the cable 16, thereby preventing removal of the cable from the recess 28, and the locking fingers 34 have been pushed into the structure 30.

The cable 16 is now securely attached to the well screen 22, and is protected within the recess 28, so that it will not be damaged during conveyance and installation in the wellbore 14. It will be appreciated that the procedure for securing the cable 16 is quite easily accomplished—involving merely rotation of the clip 24 over the cable 16 and snapping the fingers 34 into the structure 30. Thus, the operation can be performed quickly, efficiently, accurately, conveniently, and without significantly impeding the installation of the tubular string 12 in the wellbore 14.

Figure 6:
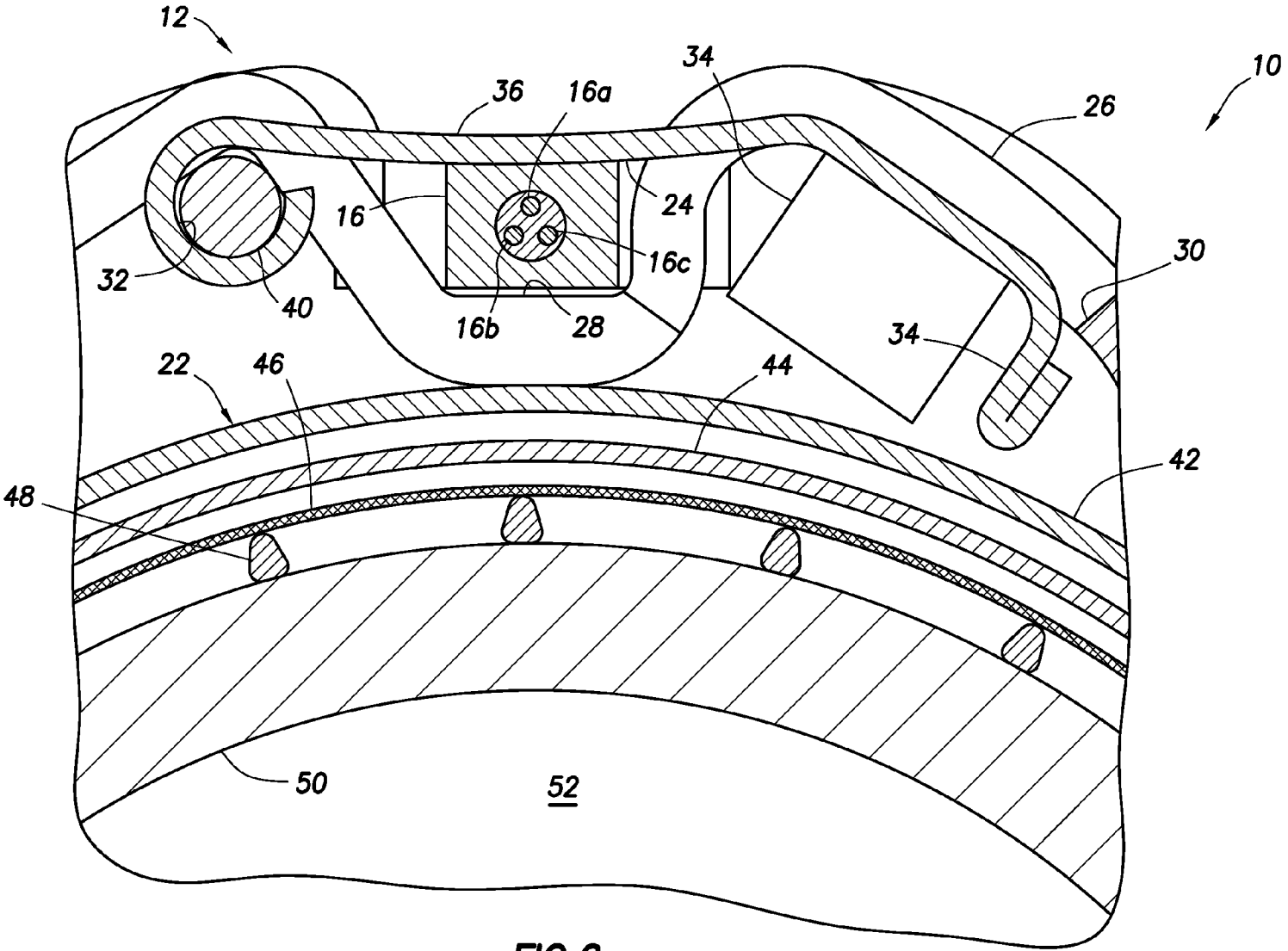
FIG. 6 is a schematic cross-sectional view of the attachment system, taken along line 6-6 of FIG. 2.

Referring additionally now to FIG. 6, a cross-sectional view of the attachment system 20 is representatively illustrated. In this view, the manner in which the body 36 of the clip 24 retains the cable 16 in the recess 28 can be seen. Preferably, the body 36 is configured so that it applies a biasing force to the cable 16 when the locking fingers 34 are engaged with the structure 30.

In this view, it may also be seen that the well screen 22 in this example includes an outer shroud 42, an intermediate layer 44, a filter layer 46 (e.g., wire wraps), a drainage layer 48 (e.g., longitudinally extending rods) and a base pipe 50. The well screen 22 operates to filter debris (sand, fines, etc.) from fluid passing through the shroud 42, layers 44, 46, 48 and into a flow passage 52 extending through the base pipe 50 and the remainder of the tubular string 12. Of course, other types of well screens (e.g., sintered, wire mesh, prepacked, expanded, etc.), any number or type of layers may be used, etc., in keeping with the principles of this disclosure.

The cable 16, as depicted in FIG. 6, includes several lines 16*a-c*. The lines 16*a-c* can include any number (including one) or combination of lines, such as, electrical lines, hydraulic lines, fiber optic lines (or other optical waveguides), or any other types of lines.

Figure 7:
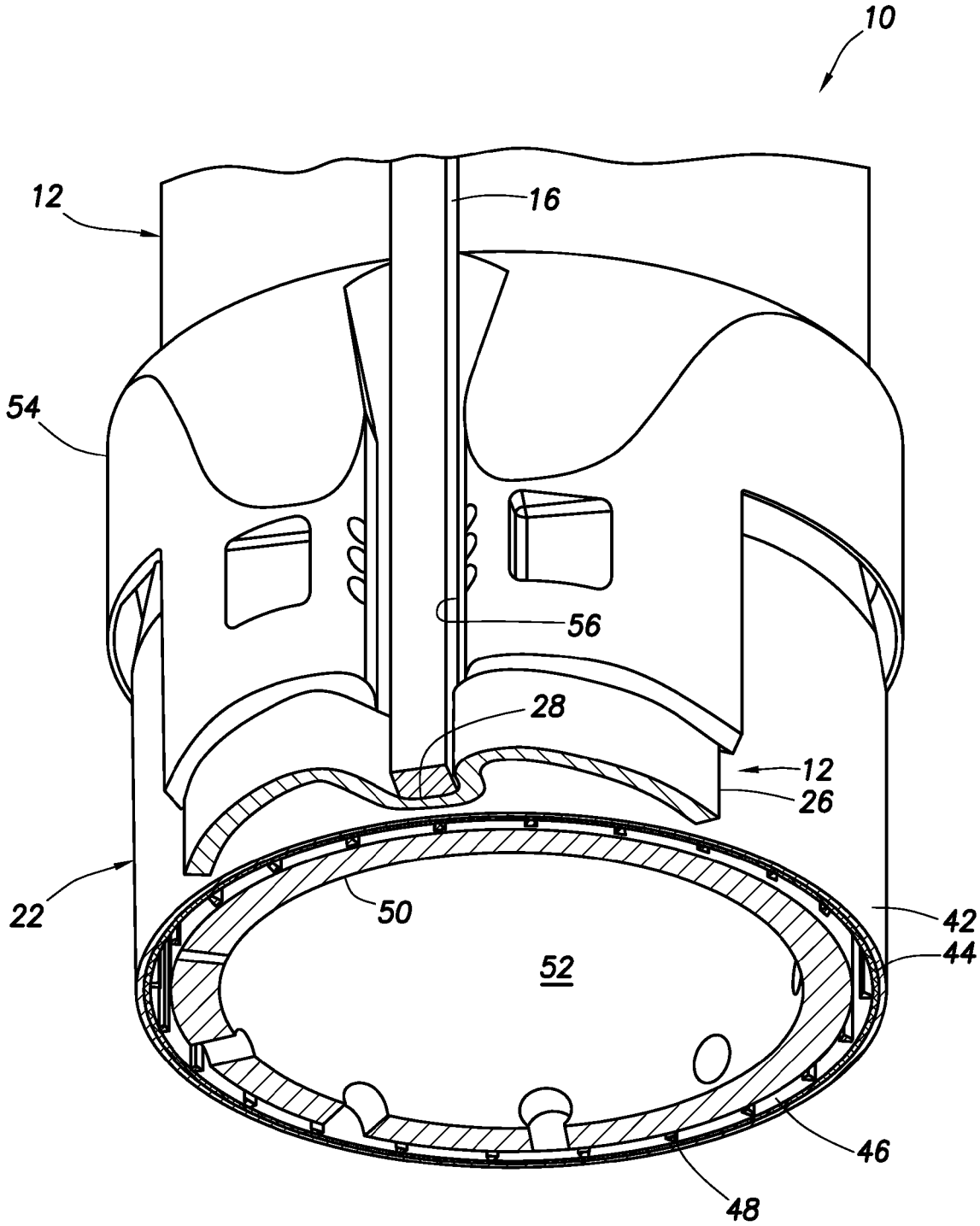
FIG. 7 is a schematic cross-sectional view of the attachment system, taken along line 7-7 of FIG. 2.

Referring additionally now to FIG. 7, a cross-sectional view of the well screen 22 and attachment system 20 is representatively illustrated. In this view, the manner in which the support 26 is attached to the well screen 22 can be seen.

Note that the support 26 is in this example welded to an outer surface of the outer shroud 42. However, in other examples, the support 26 could be formed as part of the shroud 42, the support could be otherwise attached to the shroud, the support could be attached to, or part of, another component of the well screen 22, etc.

At the end of the well screen 22, an end ring 54 abuts the support 26 and provides a transition to the remainder of the tubular string 12. A longitudinal recess 56 formed in the end ring 54 is aligned with the recess 28 in the support 26 and receives the cable 16 therein. The recess 56 is preferably inclined to provide a smooth transition in the radial direction, due to the different diameters of the well screen 22 and the remainder of the tubular string 12.

Figure 8:
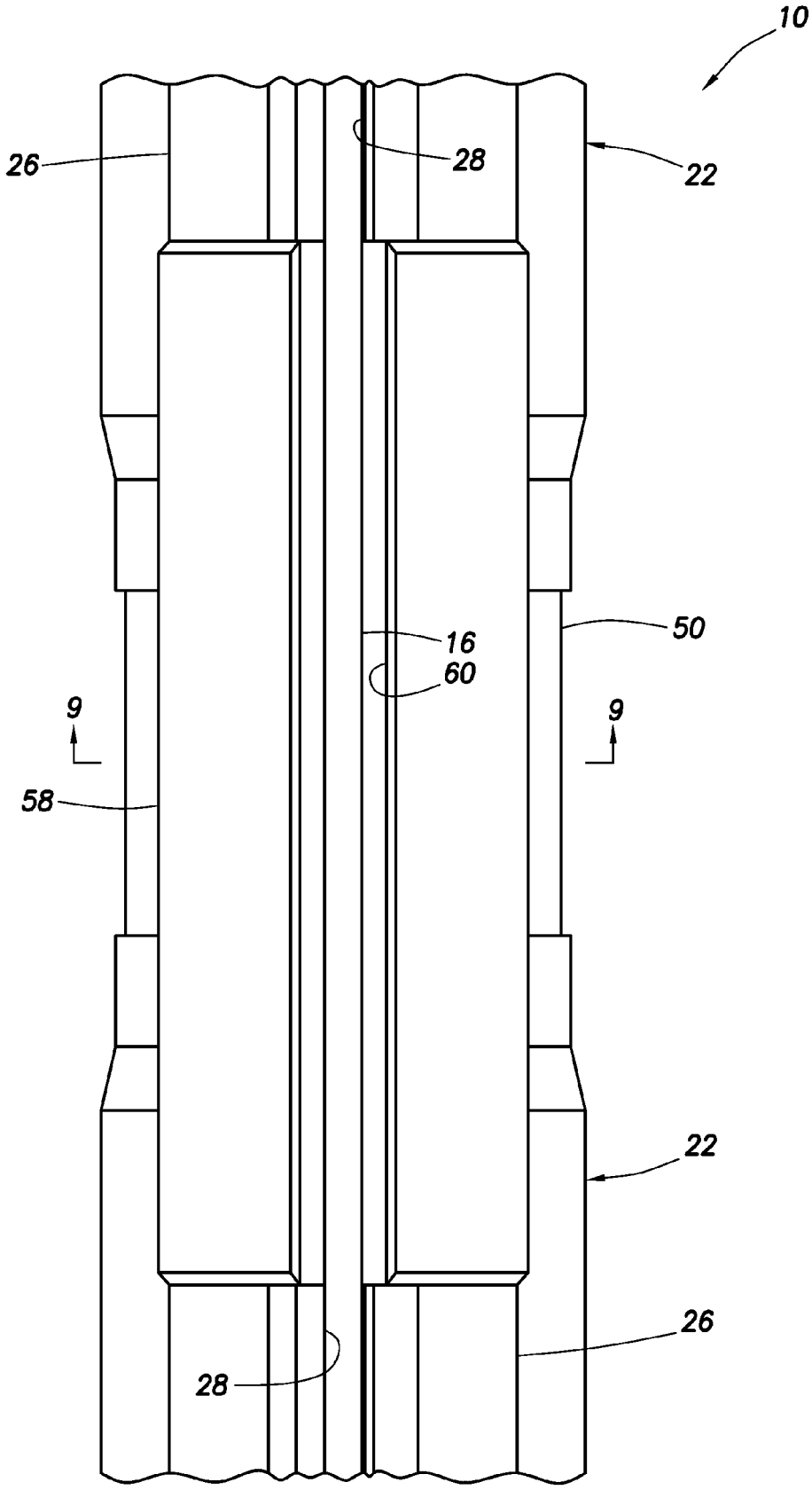
FIG. 8 is a schematic elevational view of a well screen joint in the attachment system.

Referring additionally now to FIG. 8, another protective device 58 is used to protect the cable 16 between two well screens 22. The protective device 58 includes a recess 60 therein which is aligned with the recesses 28 in the supports 26 attached to the well screens 22.

Figure 9:
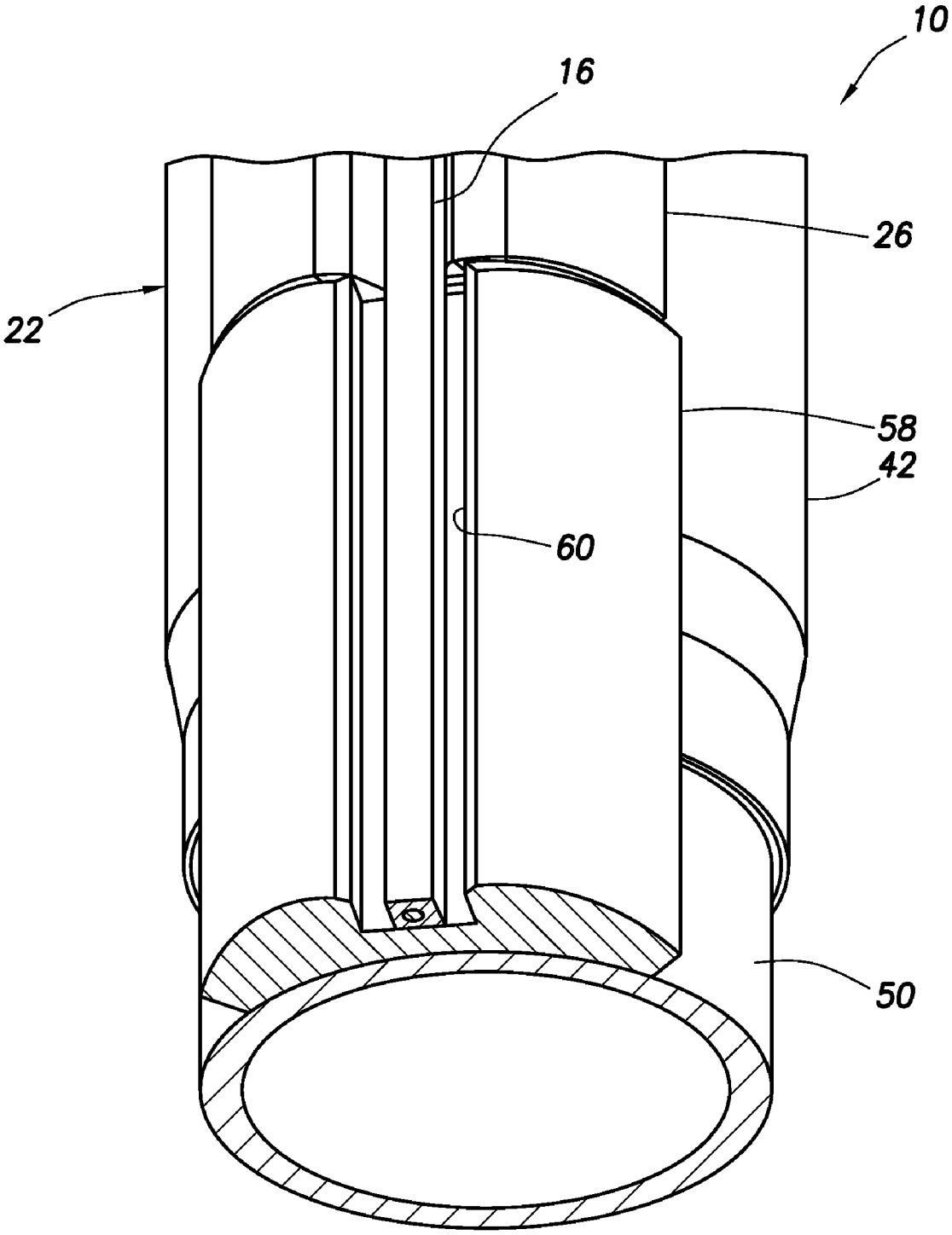
FIG. 9 is a schematic cross-sectional view of the well screen joint, taken along line 9-9 of FIG. 8.

Referring additionally now to FIG. 9, a cross-sectional view of the protective device 58 and well screen 22 is representatively illustrated. The protective device 58 may be attached (e.g., by welding, bonding, integrally forming, molding, or any other technique) directly to the base pipe 50, to the shroud 42, the support 26 and/or any other components of the well screen 22 or tubular string 12.

It may now be fully appreciated that the above disclosure provides significant advancements to the art of attaching lines to tubular strings. In the example of the system 10 and method described above, the cable 16 can be readily attached to the tubular string 12 while it is being installed in the wellbore 14.

The above disclosure provides to the art a system 20 which attaches at least one line 16*a-c* to a tubular string 12. The system 20 can include at least one clip 24 pivotably secured on one side of a recess 28, and at least one structure 30 positioned on an opposite side of the recess 28. Rotation of the clip 24 into engagement with the structure 30 secures the line 16*a-c* in the recess 28.

The structure 30 may comprise an opening. The opening may be formed in a support 26. The recess 28 may also be formed in the support 26. The clip 24 can be pivotably secured to the support 26.

The support 26 may be secured to a well screen 22. The system 20 can also include an end ring 54 which abuts an end of the support 26 and secures the support 26 to a base pipe 50 of the well screen 22.

The clip 24 may be rotated into engagement with the structure 30 as the tubular string 12 is conveyed into a wellbore 14.

Also described by the above disclosure is a method of attaching at least one line 16*a-c* to a tubular string 12. The method can include securing the line 16*a-c* to a support 26 on the tubular string 12 as the tubular string is being conveyed into a wellbore 14. The securing step may comprise rotating at least one clip 24 into engagement with at least one structure 30, thereby preventing removal of the line 16*a-c* from a recess 28 formed in the support 26.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A system which attaches at least one line to a tubular string, the system comprising:

at least one clip pivotably secured on a first side of a recess;

at least one locking feature on the clip;

at least one opening which is formed in a support, wherein the opening is positioned on a second side of the recess opposite from the first side; and wherein rotation of the clip engages the at least one locking feature, and wherein the locking feature secures the line in the recess.

2. The system of claim 1, wherein the recess is formed in the support.

3. The system of claim 2, wherein the clip is pivotably secured to the support.

4. The system of claim 1, wherein the support is secured to a well screen.

5. The system of claim 4, further comprising an end ring which abuts an end of the support and secures the support to a base pipe of the well screen.

6. The system of claim 1, wherein the locking feature comprises a locking finger.

7. A method of attaching at least one line to a tubular string, the method comprising:

securing the line to a support on the tubular string as the tubular string is being conveyed into a wellbore; and the securing step further comprising rotating at least one clip and engaging at least one locking feature of the clip with at least one structure, thereby preventing removal of the line from a recess formed in the support.

8. The method of claim 7, wherein the clip is pivotably secured on a first side of the recess.

9. The method of claim 8, wherein the structure is positioned on a second side of the recess opposite from the first side.

10. The method of claim 7, wherein the structure comprises an opening.

11. The method of claim 10, wherein the opening is formed in the support.

12. The method of claim 11, wherein the recess is formed in the support.

13. The method of claim 12, wherein the clip is pivotably secured to the support.

14. The method of claim 7, wherein the support is secured to a well screen.

15. The method of claim 14, further comprising an end ring which abuts an end of the support and secures the support to a base pipe of the well screen.

16. The method of claim 7, wherein the locking feature comprises a locking finger.

17. A system which attaches at least one line to a tubular string, the system comprising:

at least one clip pivotably secured on a first side of a recess;

at least one opening which is formed in a support, wherein the opening is positioned on a second side of the recess opposite from the first side and the support is secured to a well screen; and wherein rotation of the clip into engagement with the opening secures the line in the recess.

18. A method of attaching at least one line to a tubular string, the method comprising:

securing the line to a support on the tubular string as the tubular string is being conveyed into a wellbore, wherein the support is secured to a well screen; and the securing step further comprising rotating at least one clip into engagement with at least one structure, thereby preventing removal of the line from a recess formed in the support.

* * * * *